US011837138B2

(12) United States Patent
Lee

(10) Patent No.: US 11,837,138 B2
(45) Date of Patent: Dec. 5, 2023

(54) CONTROL CIRCUIT AND METHOD FOR LOW-TEMPERATURE POLY-SILICON PIXEL ARRAY

(71) Applicant: OMNIVISION TDDI ONTARIO LIMITED PARTNERSHIP, Grand Cayman (KY)

(72) Inventor: Kun-Hua Lee, Zhubei (TW)

(73) Assignee: OMNIVISION TDDI ONTARIO LIMITED PARTNERSHIP, Grand Cayman (KY)

( * ) Notice: Subject to any disclaimer, the term of this patent is extended or adjusted under 35 U.S.C. 154(b) by 22 days.

(21) Appl. No.: 17/848,257

(22) Filed: Jun. 23, 2022

(65) Prior Publication Data

US 2022/0415237 A1 Dec. 29, 2022

(30) Foreign Application Priority Data

Jun. 24, 2021 (CN) ..... 202110704438.8

(51) Int. Cl.
*G09G 3/20* (2006.01)

(52) U.S. Cl.
CPC ... *G09G 3/2003* (2013.01); *G09G 2300/0452* (2013.01); *G09G 2300/08* (2013.01); *G09G 2310/08* (2013.01); *G09G 2330/021* (2013.01)

(58) Field of Classification Search
CPC ..... G09G 3/3233
See application file for complete search history.

(56) References Cited

U.S. PATENT DOCUMENTS

2007/0013634 A1* 1/2007 Saiki ..... G09G 3/3674 345/98
2016/0148981 A1* 5/2016 Matsueda ..... H10K 59/353 257/40

* cited by examiner

*Primary Examiner* — Nan-Ying Yang
(74) *Attorney, Agent, or Firm* — Muncy, Geissler, Olds & Lowe, P.C.

(57) ABSTRACT

A control circuit for a low-temperature poly-silicon array controls the low-temperature poly-silicon array including M rows×N columns of pixel units. The control circuit includes N operational amplifiers, a comparison unit, and a pixel input switch control unit. The comparison unit determines pixel values of N red subpixels, N green subpixels, and N blue subpixels in at least one row of pixel units of the M rows of pixel units are the same as each other. The pixel input switch control unit controls, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

24 Claims, 7 Drawing Sheets

70

CONTROL CIRCUIT AND METHOD FOR LOW-TEMPERATURE POLY-SILICON PIXEL ARRAY

BACKGROUND OF THE INVENTION

1. Field of the Invention

The present invention relates to the field of display panel control technologies, and in particular, to a control circuit and method for a low-temperature poly-silicon pixel array.

2. Description of the Related Art

With the rapid development of electronic technologies, electronic devices such as smartphones and tablet computers have become indispensable intelligent tools in people's life. Requirements of the users for the display effects and power consumption of display screens of the electronic devices are increasingly high.

In the field of displays, the low-temperature poly-silicon (LTPS) technology has become one of mature and mainstream panel technologies due to advantages such as high resolution, high response speed, high brightness, and high aperture ratio, thereby being widely used in the smartphones and tablet computers.

Nevertheless, an LTPS display panel still has a disadvantage of relatively high power consumption, and in particular in some specific display modes, the existing LTPS technology still lacks effective power consumption control means to reduce unnecessary power consumption, which limits further application of the technology.

In view of this, there is an urgent need in the field to provide an improved solution to reduce power consumption in specific display modes.

SUMMARY OF THE INVENTION

In view of this, the present disclosure provides a control circuit and control method for a low-temperature poly-silicon pixel array, to reduce power consumption in specific display modes.

According to an embodiment of the present invention, a control circuit for a low-temperature poly-silicon pixel array is provided, configured to control the low-temperature poly-silicon pixel array. The low-temperature poly-silicon pixel array includes: M rows×N columns of pixel units, where each pixel unit includes a red subpixel, a green subpixel, and a blue subpixel, both M and N being integers greater than 0; N red pixel input switches, including a first red pixel input switch to an Nth red pixel input switch, where input ends of M red subpixels located in an ath column of pixel units are coupled to each other, and are coupled to an ath red pixel input switch in the first red pixel input switch to the Nth red pixel input switch, a being an integer from 1 to N; N green pixel input switches, including a first green pixel input switch to an Nth green pixel input switch, where input ends of M green subpixels located in the ath column of pixel units are coupled to each other, and are coupled to an ath green pixel input switch in the first green pixel input switch to the Nth green pixel input switch; and N blue pixel input switches, including a first blue pixel input switch to an Nth blue pixel input switch, where input ends of M blue subpixels located in the ath column of pixel units are coupled to each other, and are coupled to an ath blue pixel input switch in the first blue pixel input switch to the Nth blue pixel input switch. The control circuit includes: N operational amplifiers, including a first operational amplifier to an Nth operational amplifier corresponding to a first column of pixel units to an Nth column of pixel units respectively, where the input ends of the M red subpixels located in the ath column of pixel units are coupled to an ath operational amplifier through the ath red pixel input switch, the input ends of the M green subpixels located in the ath column of pixel units are coupled to the ath operational amplifier through the ath green pixel input switch, and the input ends of the M blue subpixels located in the ath column of pixel units are coupled to the ath operational amplifier through the ath blue pixel input switch; a comparison unit, configured to determine whether pixel values of N red subpixels, N green subpixels, and N blue subpixels in at least one row of pixel units of the M rows of pixel units are the same as each other; and a pixel input switch control unit, configured to control, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

According to another embodiment of the present invention, a control method for a low-temperature poly-silicon pixel array is provided. The low-temperature poly-silicon pixel array includes: M rows×N columns of pixel units, where each pixel unit includes a red subpixel, a green subpixel, and a blue subpixel, both M and N being integers greater than 0; N red pixel input switches, including a first red pixel input switch to an Nth red pixel input switch, where input ends of M red subpixels located in an ath column of pixel units are coupled to each other, and are coupled to an ath red pixel input switch in the first red pixel input switch to the Nth red pixel input switch, a being an integer from 1 to N; N green pixel input switches, including a first green pixel input switch to an Nth green pixel input switch, where input ends of M green subpixels located in the ath column of pixel units are coupled to each other, and are coupled to an ath green pixel input switch in the first green pixel input switch to the Nth green pixel input switch; and N blue pixel input switches, including a first blue pixel input switch to an Nth blue pixel input switch, where input ends of M blue subpixels located in the ath column of pixel units are coupled to each other, and are coupled to an ath blue pixel input switch in the first blue pixel input switch to the Nth blue pixel input switch. The control method includes: determining whether pixel values of N red subpixels, N green subpixels, and N blue subpixels in at least one row of pixel units of the M rows of pixel units are the same as each other; and controlling, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

According to still another embodiment of the present invention, a control circuit for a low-temperature poly-silicon pixel array is provided, configured to control the low-temperature poly-silicon pixel array. The low-temperature poly-silicon pixel array includes: M rows×N columns of pixel units, where each pixel unit includes a red subpixel, a green subpixel, and a blue subpixel, M being an integer greater than 0, and N being an even number greater than 0; N red pixel input switches, including a first red pixel input switch to an Nth red pixel input switch, where input ends of M red subpixels located in an ath column of pixel units are coupled to each other, and are coupled to an ath red pixel input switch in the first red pixel input switch to the Nth red pixel input switch, a being an integer from 1 to N; N green pixel input switches, including a first green pixel input switch to an Nth green pixel input switch, where input ends of M green subpixels located in the ath column of pixel units are coupled to each other, and are coupled to an ath green pixel input switch in the first green pixel input switch to the Nth green pixel input switch; and N blue pixel input switches, including a first blue pixel input switch to an Nth blue pixel input switch, where input ends of M blue subpixels located in the ath column of pixel units are coupled to each other, and are coupled to an ath blue pixel input switch in the first blue pixel input switch to the Nth blue pixel input switch. The control circuit includes: N/2 operational amplifiers, including a first operational amplifier to an (N/2)th operational amplifier, where the input ends of the M red subpixels located in the ath column of pixel units are coupled to an ⌈a/2⌉th operational amplifier (the expression "⌈a/2⌉" used herein and below refers to performing a rounding operation on a value of a/2) through the ath red pixel input switch, the input ends of the M green subpixels located in the ath column of pixel units are coupled to the ⌈a/2⌉th operational amplifier through the ath green pixel input switch, and the input ends of the M blue subpixels located in the ath column of pixel units are coupled to the ⌈a/2⌉th operational amplifier through the ath blue pixel input switch; a comparison unit, configured to determine whether pixel values of N red subpixels, N green subpixels, and N blue subpixels in at least one row of pixel units of the M rows of pixel units are the same as each other; and a pixel input switch control unit, configured to control, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

According to still another embodiment of the present invention, a control method for a low-temperature poly-silicon pixel array is provided. The low-temperature poly-silicon pixel array includes: M rows×N columns of pixel units, where each pixel unit includes a red subpixel, a green subpixel, and a blue subpixel, both M and N being integers greater than 0; N red pixel input switches, including a first red pixel input switch to an Nth red pixel input switch, where input ends of M red subpixels located in an ath column of pixel units are coupled to each other, and are coupled to an ath red pixel input switch in the first red pixel input switch to the Nth red pixel input switch, a being an integer from 1 to N; N green pixel input switches, including a first green pixel input switch to an Nth green pixel input switch, where input ends of M green subpixels located in the ath column of pixel units are coupled to each other, and are coupled to an ath green pixel input switch in the first green pixel input switch to the Nth green pixel input switch; and N blue pixel input switches, including a first blue pixel input switch to an Nth blue pixel input switch, where input ends of M blue subpixels located in the ath column of pixel units are coupled to each other, and are coupled to an ath blue pixel input switch in the first blue pixel input switch to the Nth blue pixel input switch. The control method includes: determining whether pixel values of N red subpixels, N green subpixels, and N blue subpixels in at least one row of pixel units of the M rows of pixel units are the same as each other; and controlling, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

The embodiments of the present invention can reduce power consumption of the low-temperature poly-silicon pixel array in specific display modes.

PREFERRED EMBODIMENT OF THE PRESENT INVENTION

To better understand the spirit of the present invention, a further description is provided below in conjunction with some preferred embodiments of the present invention.

A plurality of implementations or examples are provided below to implement different features of this present disclosure. A specific example of an assembly and a configuration described below is used to simplify the present disclosure. It is contemplated that such descriptions are merely examples, and are not intended to limit the present disclosure. For example, in the following description, a first feature is formed on or above a second feature, and the description may include that, in some embodiments, the first feature and the second feature directly contact with each other; and the description may further include that, in some embodiments, an additional assembly is formed between the first feature and the second feature so that the first feature and the second feature may not be in direct contact. In addition, the present disclosure may repeat assembly symbols and/or labels in various embodiments. The repetition is for the purpose of brevity and clarity, but does not indicate a relationship between the various embodiments and/or configurations discussed.

Hereinafter, various implementations of the present invention will be described in detail. Although specific implementations are discussed, it should be understood that these implementations are merely for illustrative objectives. A person skilled in the art knows that, other components and configurations may be used without departing from the spirit and the scope of the present invention.

Figure 1:
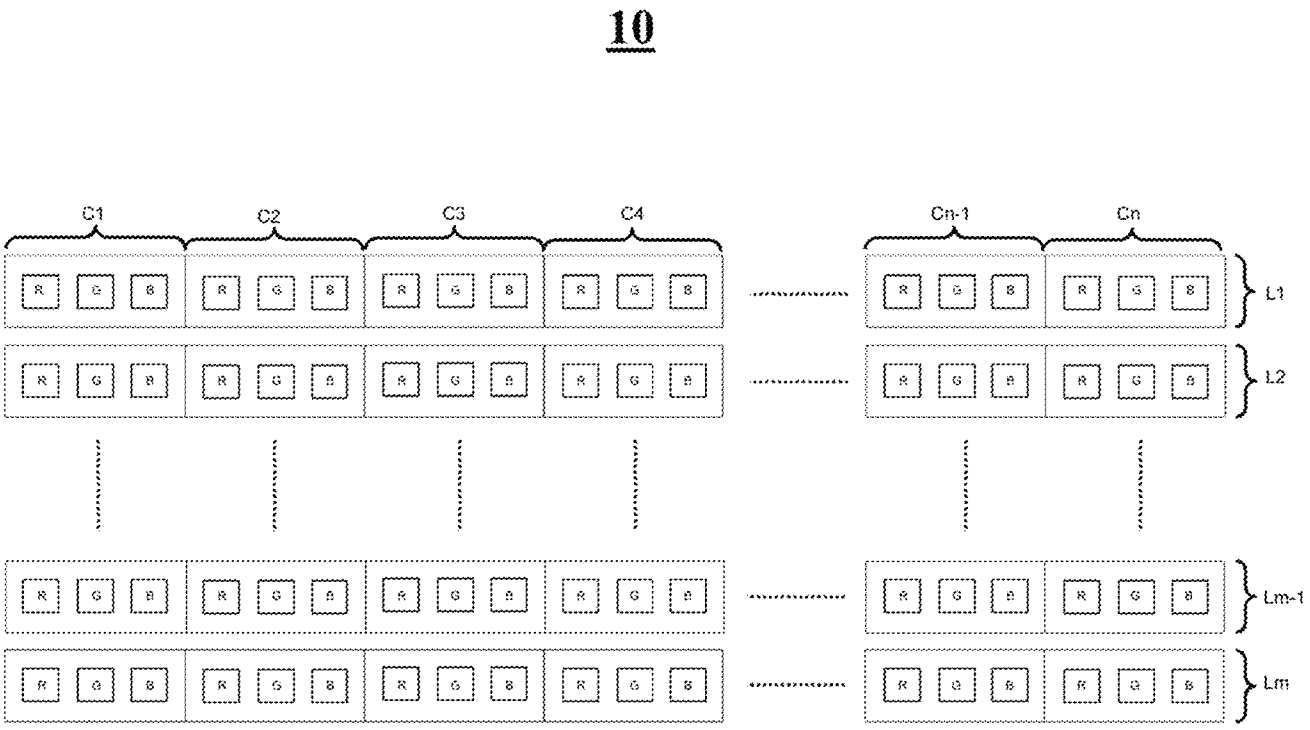
FIG. 1 shows a schematic structural diagram of a low-temperature poly-silicon pixel array.

FIG. 1 shows a schematic structural diagram of a low-temperature poly-silicon pixel array. As shown in FIG. 1, a display panel (10) includes a low-temperature poly-silicon array formed by M rows×N columns of pixel units. The M rows of pixel units are displayed as a pixel unit row L1, a pixel unit row L2, . . . , a pixel unit row L(m−1), and a pixel unit row Lm in FIG. 1, and the N columns of pixel units are displayed as a pixel unit column C1, a pixel unit column C2, . . . , a pixel unit column C(n−1), and a pixel unit column Cn in FIG. 1, where M, N, m, and n are all positive integers. Moreover, each pixel unit in the M rows×N columns of pixel units includes a red subpixel, a green subpixel, and a blue subpixel, which are represented as R, G, and B respectively in FIG. 1.

Figure 2:
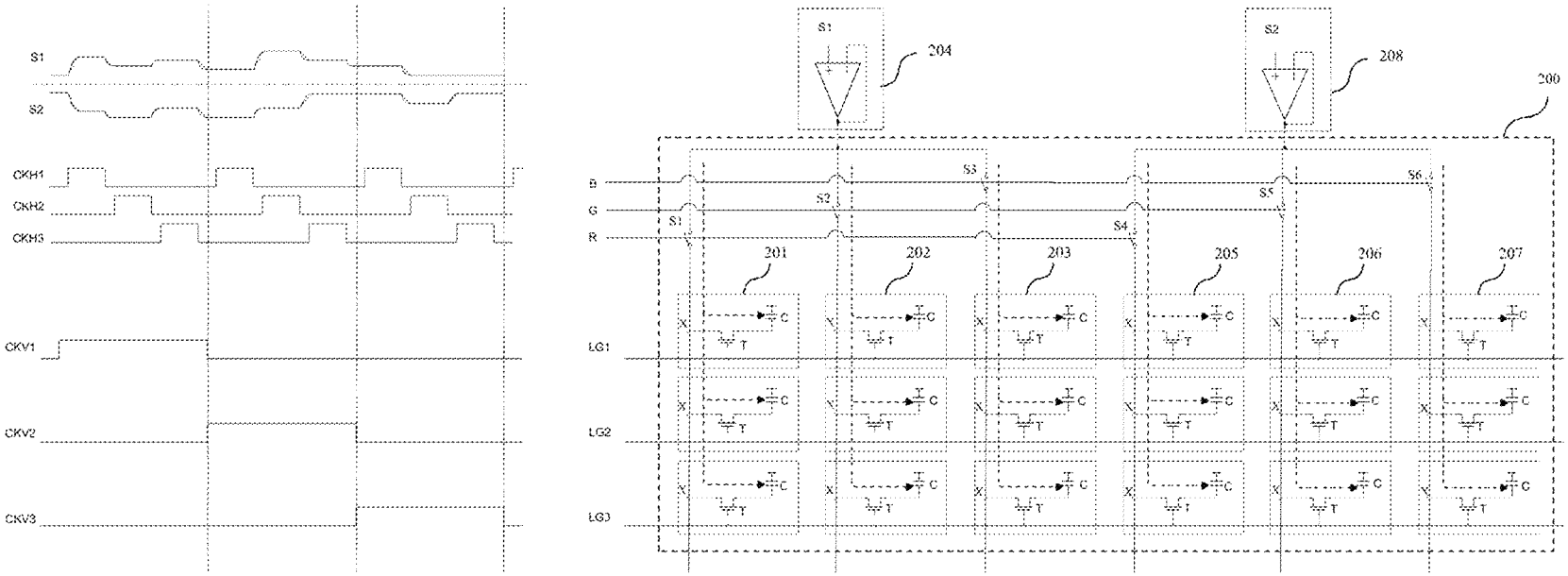
FIG. 2 shows a schematic diagram of implementing control on a low-temperature poly-silicon pixel array.

FIG. 2 shows a schematic diagram of implementing control on a low-temperature poly-silicon pixel array. Similar to the display panel (10) shown in FIG. 1, a display panel (200) in FIG. 2 includes M rows×N columns of pixel units, and each pixel unit includes a red subpixel, a green subpixel, and a blue subpixel, where both M and N are positive integers. The display panel (200) includes N red pixel input switches, N green pixel input switches, and N blue pixel input switches. The N red pixel input switches include a first red pixel input switch to an Nth red pixel input switch, where input ends of M red subpixels located in an ath column of pixel units are coupled to each other, and are coupled to an ath red pixel input switch in the first red pixel input switch to the Nth red pixel input switch, a being an integer from 1 to N. Similarly, the N green pixel input switches include a first green pixel input switch to an Nth green pixel input switch, where input ends of M green subpixels located in the ath column of pixel units are coupled to each other, and are coupled to an ath green pixel input switch in the first green pixel input switch to the Nth green pixel input switch. The N blue pixel input switches include a first blue pixel input switch to an Nth blue pixel input switch, where input ends of M blue subpixels located in the ath column of pixel units are coupled to each other, and are coupled to an ath blue pixel input switch in the first blue pixel input switch to the Nth blue pixel input switch. The ath red pixel input switch uniformly accepts control of a CKH3 signal in pixel input switch control signals (hereinafter referred to as CKHs) via a red pixel input switch control line (R), the ath green pixel input switch a uniformly accepts control of a CKH2 signal via a green pixel input switch control line (G), and the ath blue pixel input switch uniformly accepts control of a CKH1 signal via a blue pixel input switch control line (B).

For an exemplary purpose, FIG. 2 only shows 3 rows×2 columns of local pixel units in the display panel (200) including the M rows×N columns of pixel units, that is, a total of six adjacent pixel units shown in FIG. 2. A pixel unit located in a first row and a first column of FIG. 2 includes a red subpixel (201), a green subpixel (202), and a blue subpixel (203), and an interior of each subpixel (201, 202, 203) includes a transistor T and a capacitor C. A drain of each transistor T in FIG. 2 is coupled to an input end X of a subpixel in which the transistor T is located, a source of each transistor T is coupled to one end of a capacitor C in the subpixel in which the transistor T is located, and a gate of each transistor T is coupled to a corresponding row selection line (L1, L2, L3), and an other end of each capacitor C is coupled to a common voltage (commonly referred to as a VCOM voltage in the field) of the display panel (200). It should be understandable that, a parasitic capacitor (not shown) may also be included between the source and the gate of each transistor T.

In addition, assignment of each of the M rows×N columns of pixel units (that is, each capacitor C is charged to a corresponding voltage) is performed by N operational amplifiers. The N operational amplifiers include a first operational amplifier to an Nth operational amplifier corresponding to a first column of pixel units to an Nth column of pixel units respectively, where the input ends of the M red subpixels located in the ath column of pixel units are coupled to an ath operational amplifier through the ath red pixel input switch, the input ends of the M green subpixels located in the ath column of pixel units are coupled to the ath operational amplifier through the ath green pixel input switch, and the input ends of the M blue subpixels located in the ath column of pixel units are coupled to the ath operational amplifier through the ath blue pixel input switch, a being an integer from 1 to N. For an exemplary purpose, still referring to the 3 rows×2 columns of pixel units shown in FIG. 2, input ends X of three red subpixels (including the red subpixel (201)) in the first column are coupled to a first operational amplifier (204) through a first red pixel input switch S1, input ends X of three green subpixels in the first column (including the green subpixel (202)) are coupled to the first operational amplifier (204) through a first green pixel input switch S2, and input ends X of three blue subpixels in the first column (including the blue subpixel (203)) are coupled to the first operational amplifier (204) through a first blue pixel input switch S3. Similarly, input ends X of three red subpixels (including a red subpixel (205)) in a second column are coupled to a second operational amplifier (208) through a second red pixel input switch S4, input ends X of three green subpixels in the second column (including a green subpixel (206)) are coupled to the second operational amplifier (208) through a second green pixel input switch S5, and input ends X of three blue subpixels in the second column (including a blue subpixel (207)) are coupled to the second operational amplifier (208) through a second blue pixel input switch S6. In FIG. 2, a non-inverting input end (+) of the first operational amplifier (204) receives an input signal S1, and an inverting input end (−) is coupled to an output end of the first operational amplifier (204) to form a voltage follower. Similarly, a non-inverting input end (+) of the second operational amplifier (208) receives an input signal S2, and an inverting input end (−) is coupled to an output end of the second operational amplifier (208) to form a voltage follower.

By applying control signals shown in a left side of FIG. 2, display control of the display panel (200) may be implemented. The six adjacent pixel units of 3 rows×2 columns shown in FIG. 2 are still used as an example. In an operation process, a first row selection signal CKV1 in pixel row selection signals (hereinafter referred to as CKVs) is first triggered to selectively turn on all transistors T in the first row of pixel units via a row selection line (LG1), and then the CKH1, CKH2, and CKH3 signals are sequentially triggered in a period that the first row selection signal CKV1 is triggered, to assign to blue, green, and red subpixel units of columns in the first row of pixel units. It should be noted that, in this embodiment, the triggering means that a signal is converted from a logic low level to a logic high level, but this application is not limited thereto. For example, the CKH1 signal is first triggered to close all blue pixel input switches in the first row of pixel units so that the input end of the blue subpixel (203) in the first column of pixel units is coupled to the first operational amplifier (204) and the input end of the blue subpixel (207) in the second column of pixel units is coupled to the second operational amplifier (208), so as to charge the capacitor C in the blue subpixel (203) via the first operational amplifier (204) by using the input signal S1 and charge the capacitor C in the blue subpixel (207) via the second operational amplifier (208) by using the input signal S2. After the CKH1 signal is triggered, the CKH2 and CKH3 signals are sequentially triggered to assign to green and red subpixel units of columns in the first row of pixel units. The process is similar to the process of triggering the CKH1 signal to assign to blue subpixel units of columns in the first row of pixel units, and details are not repeated herein. After the assignment of the first row of pixel units is completed, the second CKV signal CKV2 is immediately triggered to selectively turn on all transistors T in a second row of pixel units via a row selection line (LG2), and then the CKH1, CKH2, and CKH3 signals are sequentially triggered, to assign to blue, green, and red subpixel units of columns in the second row of pixel units. Similarly, after the assignment of the second row of pixel units is completed, the third CKV signal CKV3 is immediately triggered to selectively turn on all transistors T in a third row of pixel units via a row selection line (LG3), and then the CKH1, CKH2, and CKH3 signals are sequentially triggered, to assign to blue, green, and red subpixel units of columns in the third row of pixel units. It should be understood that, the CKH signals and the CKV signals may also be triggered in a low-level manner or another applicable manner. It should be still understood that, the trigger sequence of the CKH signals is not limited to CKH1, CKH2 to CKH3 shown in FIG. 2, and the trigger sequence of the CKV signals is also not limited to CKV1, CKV2 to CKV3 shown in FIG. 2.

In this way, display control of the display panel (200) may be implemented. It can be seen from FIG. 2 that, in the operation process, the CKH1, CKH2, and CKH3 signals may frequently flip. Usually, the CKH signals may flip between voltages such as (but not limited to) −8 V to 10 V, and a load driven by the CKH signals may reach, such as, 150 pF to 400 pF. Therefore, the frequent flip of the CKH signals generates considerable power consumption. For general display modes, the frequent flip of the CKH signals is necessary and usually unavoidable. However, in some specific display modes, the frequent flip of the CKH signals is unnecessary and should be reduced or avoided.

Figure 3:
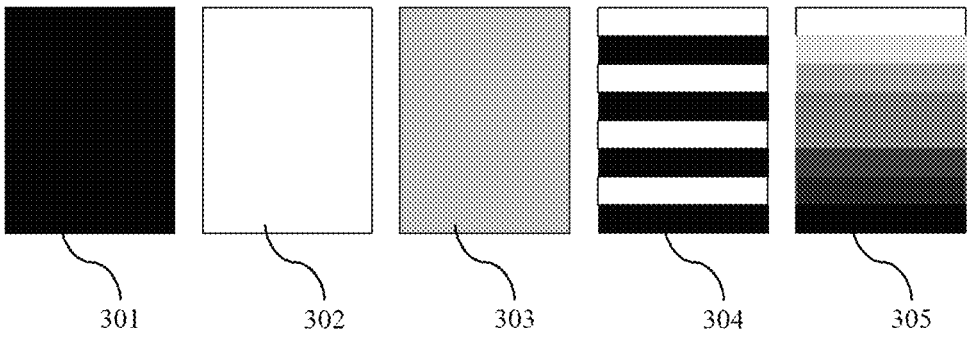
FIG. 3 shows a schematic diagram of specific display modes of a low-temperature poly-silicon pixel array.

FIG. 3 shows a schematic diagram of specific display modes of a low-temperature poly-silicon pixel array. As shown in FIG. 3, the low-temperature poly-silicon pixel array may display full-screen black in a display mode (301), where R, G, and B values thereof are 0, 0, and 0; display full-screen white in a display mode (302), where R, G, and B values thereof are 255, 255, and 255; display full-screen silver in a display mode (303), where R, G, and B values thereof are 192, 192, and 192; display full-screen horizontal black-and-white stripes in a display mode (304); and display full-screen horizontal gray-scale stripes in a display mode (305) (for example, common gray scales and corresponding R, G, and B values thereof listed in Table 1 below may be included (but the present invention is not limited thereto)).

TABLE 1

| Gray-scale name | R value | G value | B value |
|---|---|---|---|
| Dimgray | 105 | 105 | 105 |
| Gray | 128 | 128 | 128 |
| Dark gray | 169 | 169 | 169 |
| Silver | 192 | 192 | 192 |
| Light gray | 211 | 211 | 211 |
| Gainsboro | 220 | 220 | 220 |
| White smoke | 245 | 245 | 245 |

It can be seen that, a common feature of the above specific display modes is that the specific display modes are all gray-scale patterns, and the R, G, and B values of each pixel unit in any row of pixel units are the same as each other. For the above specific display modes, the frequent flip of the CKH signals is unnecessary. Therefore, if the above specific display modes can be distinguished, display control thereof different from that of the general display modes may be given, to reduce unnecessary power consumption.

To this end, the method and circuit described below in the present invention determine display modes of to-be-displayed images, and control, according to the determination result, the CKH signals to stop the unnecessary flip in, for example, the specific display modes shown in FIG. 3, thereby significantly reducing power consumption, which will be described in detail below.

Figure 4:
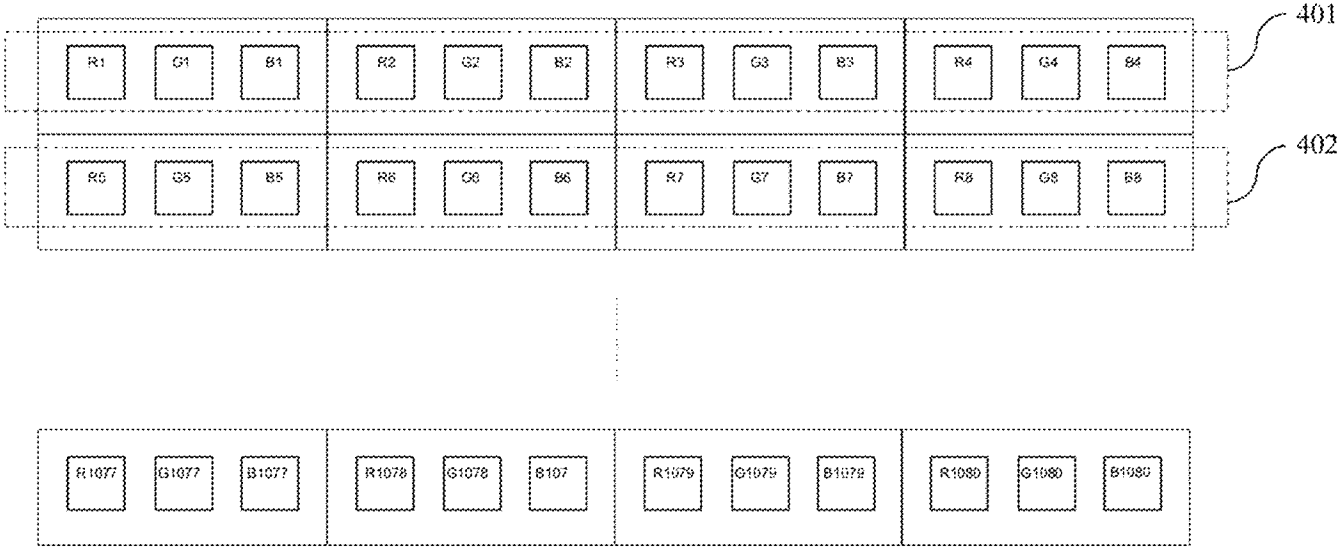
FIG. 4 shows a pixel unit grouping mode according to an embodiment of the present invention.

FIG. 4 shows a pixel unit grouping mode according to an embodiment of the present invention. For example, for a display panel with 1080 columns of pixel units, 1080 pixel units of an ath row are grouped in a manner of using every four pixel units as one group, which may be represented as the pixel unit grouping mode shown in FIG. 4, and a is an integer from 1 to 1080. It should be noted that the arrangement in FIG. 4 is for an illustration purpose only, not the arrangement manner of the 1080 pixel units of the ath row in the display panel. As shown in FIG. 4, each pixel unit includes a red subpixel, a green subpixel, and a blue subpixel. For example, a first group of pixel units (401) includes four pixel units. In the four pixel units, a first pixel unit includes a red subpixel, a green subpixel, and a blue subpixel (whose subpixel values are represented as R1, G1, and B1 respectively), a second pixel unit includes a red subpixel, a green subpixel, and a blue subpixel (whose subpixel values are represented as R2, G2, and B2, respectively), a third pixel unit includes a red subpixel, a green subpixel, and a blue subpixel (whose subpixel values are represented as R3, G3, and B3 respectively), and a fourth pixel unit includes a red subpixel, a green subpixel, and a blue subpixel (whose subpixel values are represented as R4, G4, and B4 respectively). A second group of pixel units (402) also includes four pixel units. In the four pixel units, a first pixel unit includes a red subpixel, a green subpixel, and a blue subpixel (whose subpixel values are represented as R5, G5, and B5 respectively), a second pixel unit includes a red subpixel, a green subpixel, and a blue subpixel (whose subpixel values are represented as R6, G6, and B6, respectively), a third pixel unit includes a red subpixel, a green subpixel, and a blue subpixel (whose subpixel values are represented as R7, G7, and B7 respectively), and a fourth pixel unit includes a red subpixel, a green subpixel, and a blue subpixel (whose subpixel values are represented as R8, G8, and B8 respectively).

By using the pixel unit grouping manner shown in FIG. 4 as an example, the power consumption may be reduced by performing the following operations.

For the ath row of pixel units shown in FIG. 4, it is determined whether the following conditions are satisfied in a manner of using every adjacent four pixel units as one group: whether pixel values of the red subpixel, the green subpixel, and the blue subpixel in each pixel unit are equal to each other (for example, R1=G1=B1, R2=G2=B2, R3=G3=B3, . . . ), and whether pixel values of red subpixels of two adjacent pixel units are equal to each other, whether pixel values of green subpixels of two adjacent pixel units are equal to each other, and whether pixel values of blue subpixels of two adjacent pixel units are equal to each other (for example, R1=R2, R2=R3 . . . ; G1=G2, G2=G3 . . . ; and B1=B2, B2=B3 . . . ). If the above conditions are satisfied, it is determined that pixel values of 1080 red subpixels, 1080 green subpixels, and 1080 blue subpixels in the ath row of pixel units are all the same as each other, and 1080 red pixel input switches, 1080 green pixel input switches, and 1080 blue pixel input switches are controlled to be all turned on (that is, the switches are closed) to stop the flip of the CKH signals, thereby reducing power consumption. On the contrary, if it is determined that the pixel values of the 1080 red subpixels, the 1080 green subpixels, and the 1080 blue subpixels in the ath row of pixel units are not the same, normal flip of the CKH signals is maintained.

In an embodiment, when it is determined whether the pixel values of the 1080 red subpixels, 1080 green subpixels, and 1080 blue subpixels in the ath row of pixel units are the same as each other, it may be first determined whether the pixel values of the four red subpixels, the four green subpixels, and the four blue subpixels in the first group of pixel units 401 are the same as each other. If it is determined that the pixel values are the same, it is further determined whether the pixel values of the four red subpixels, the four green subpixels, and the four blue subpixels in the first group of pixel units 401 and the pixel values of the four red subpixels, the four green subpixels, and the four blue subpixels in the second group of pixel units 402 are the same as each other.

It should be understood that, the grouping manner shown in FIG. 4 is applicable to a display panel with M rows×N columns of pixel units (where both M and N are positive integers), and pixel unit grouping is not limited to be performed by using four pixel units as one group. Instead, the grouping may be performed by using n pixel units as one group (where n is any positive integer from 1 to N). Correspondingly, for the display panel with M rows×N columns of pixel units, in a manner of using every n pixel units as one group, it may be determined whether the pixel values of N red subpixels, N green subpixels, and N blue subpixels are the same as each other in a first row of pixel units to an Mth row of pixel units of the M rows of pixel units sequentially. If the pixel values are the same, N red pixel input switches, N green pixel input switches, and N blue pixel input switches are controlled to be all turned on to stop the flip of the CKH signals, thereby reducing power consumption. If the pixel values are not the same, normal flip of the CKH signals is maintained. By analogy, the above operations may be performed one by one on a second row of pixel units to the Mth row of pixel units. In an embodiment, the above operations may be jointly performed on the first row of pixel units and the second row of pixel units, to further simplify operations and reduce power consumption.

Figure 5:
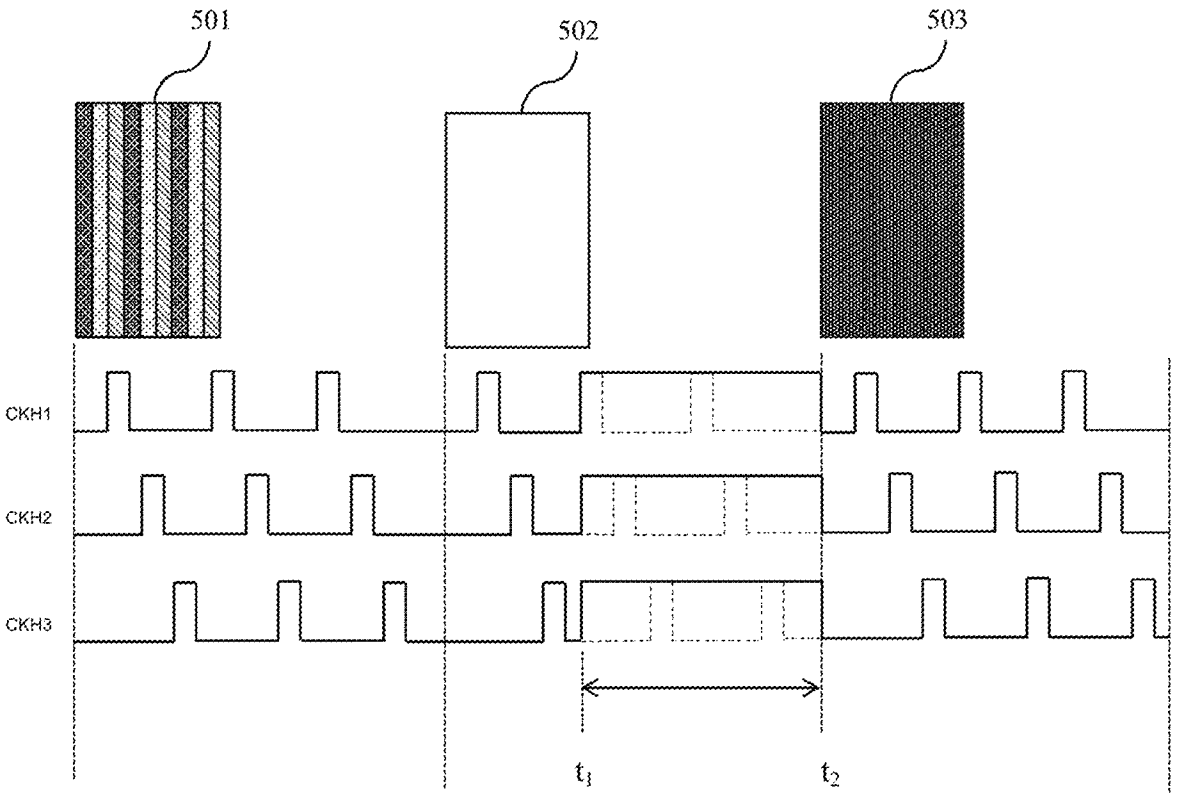
FIG. 5 shows a diagram of waveforms of CKH signals in different display modes according to an embodiment of the present invention.

FIG. 5 shows a diagram of waveforms of CKH signals in different display modes according to an embodiment of the present invention. As shown in FIG. 5, a display mode of an image (501) is longitudinal periodic color stripes. Apparently, according to the above determination method disclosed in the present invention, it may be determined that pixel values of a red subpixel, a green subpixel, and a blue subpixel in any row of pixel units in the image (501) are all not the same. Therefore, the flip of the CKH1, CKH2, and CKH3 signals is always maintained throughout an entire duration of the displayed image (501).

After the image (501) is switched to a full-screen white image (502), according to the above determination method disclosed in the present invention, it may be determined that pixel values of a red subpixel, a green subpixel, and a blue subpixel in any row of pixel units in the image (502) are all the same (that is, R=G=B=255). Therefore, after the CKH1, CKH2, and CKH3 signals complete the first flip, that is, the flip is started pausing from a time $t_1$ when the CKH1 signal is triggered for the second time, and is resumed after a time $t_2$ when the image (502) is completely displayed, thereby greatly reducing unnecessary flip of the CKH signals in a time period from $t_1$ to $t_2$ (shown in a diagram of dashed waveforms).

After the image (502) is switched to a full-red white image (503), according to the above determination method disclosed in the present invention, it may be determined that pixel values of a red subpixel, a green subpixel, and a blue subpixel in any row of pixel units in the image (503) are not all the same (that is, R=255, G=B=0, and RG=B). Therefore, the flip of the CKH1, CKH2, and CKH3 signals is also always maintained throughout an entire duration of the displayed image (503).

It can be seen that, for the image (502) with a specific display mode, the unnecessary flip of the CKH signals can be greatly reduced, thereby significantly reducing power consumption.

Figure 6:
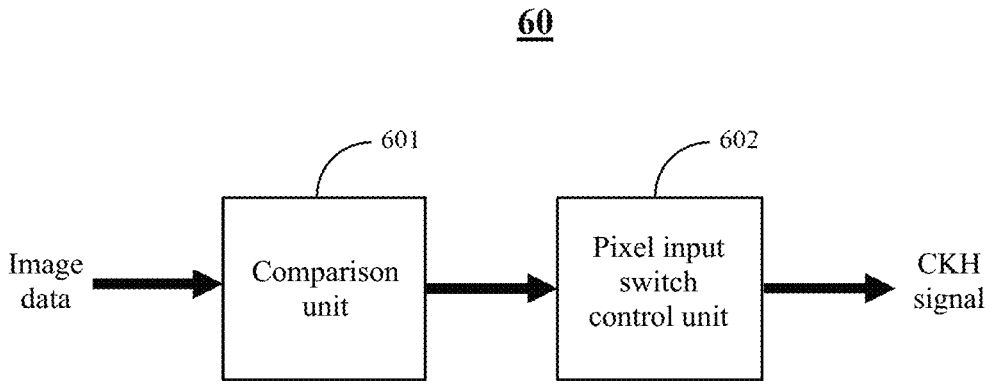
FIG. 6 shows a schematic diagram of a control circuit of a display panel according to an embodiment of the present invention.

FIG. 6 shows a schematic diagram of a control circuit of a display panel according to an embodiment of the present invention. As shown in FIG. 6, a control circuit (60) for implementing control on a display panel with M rows×N columns of pixel units includes a comparison unit (601) and a pixel input switch control unit (602).

The comparison unit (601) is configured to receive image data to be displayed on the display panel, and compare pixel values of N red subpixels, N green subpixels, and N blue subpixels in the image data by using the above determination method disclosed in the present invention, to determine whether pixel values of subpixels in at least one row of pixel units of the M rows of pixel units of the received image data are the same as each other. Once it is determined that the pixel values of the N red subpixels, the N green subpixels, and the N blue subpixels in the at least one row of pixel units of the M rows of pixel units are the same as each other, the comparison unit (601) transmits a signal to instruct the pixel input switch control unit (602) to generate CKH signals that stops flipping (for example, CKH1, CKH2, and CKH3 that stop flipping in the time period from $t_1$ to $t_2$ shown in FIG. 5) according to a system time sequence, so as to control N red pixel input switches, N green pixel input switches, and N blue pixel input switches to be all turned on (for example, control the first red pixel input switch S1, the first green pixel input switch S2, the first blue pixel input switch S3, the second red pixel input switch S4, the second green pixel input switch S5, and the second blue pixel input switch S6 in FIG. 2 to be all turned on).

It should be understood that, the control circuit (60) shown in FIG. 6 further includes N operational amplifiers (not shown in FIG. 6) corresponding to the N columns of pixel units, the comparison unit (601), the control unit (602), and the N operational amplifiers are integrated into a same chip, to control the display panel. It should be still understood that, although the analysis and determination for the to-be-displayed image data also generate a certain amount of power consumption, such the power consumption is negligible compared with the power consumption caused by the frequent flip of the CKH signals and may be ignored.

Figure 7:
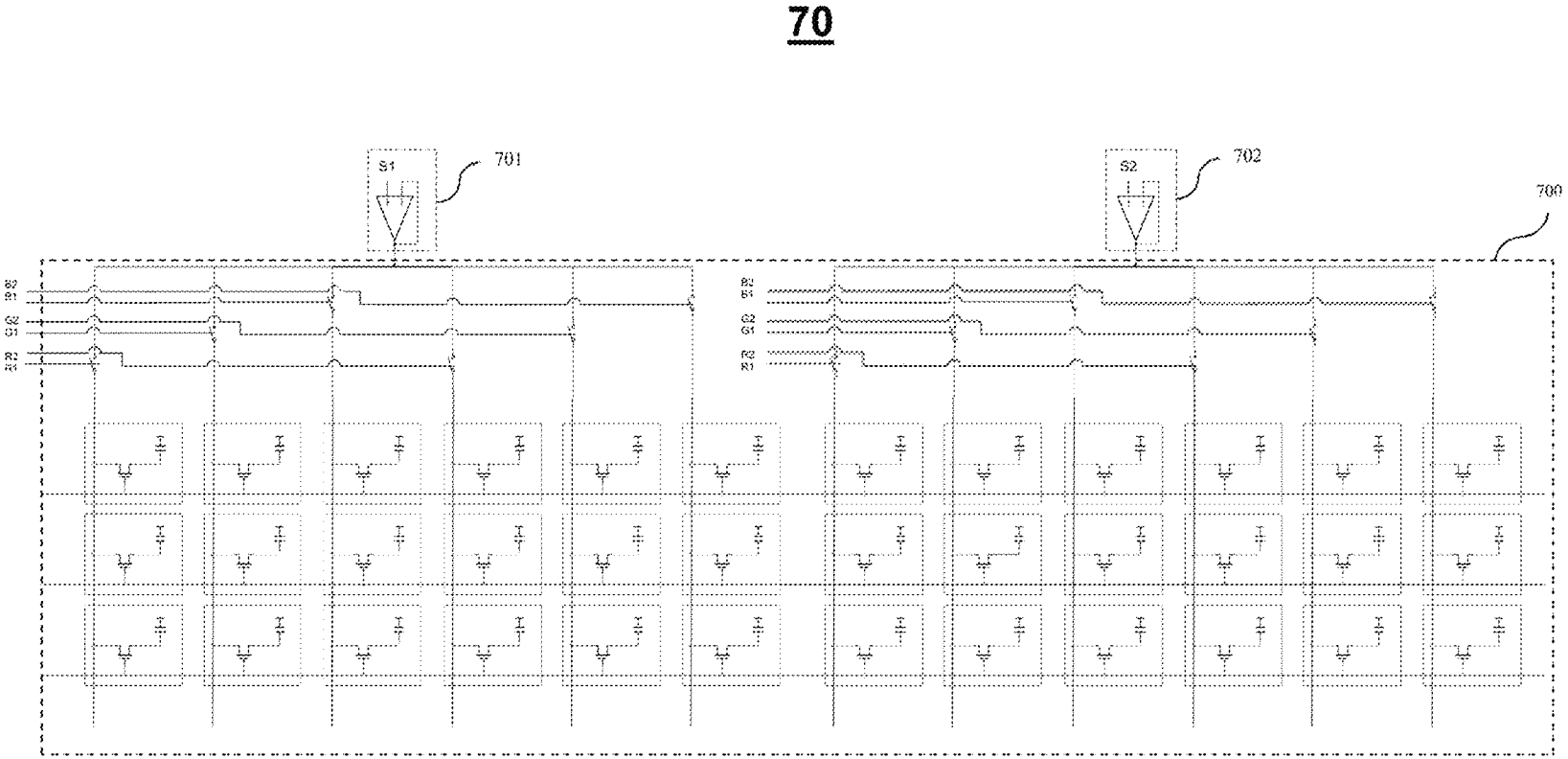
FIG. 7 shows a schematic diagram of a display panel according to an embodiment of the present invention.

FIG. 7 shows a schematic diagram of a display panel according to an embodiment of the present invention. Similar to the display panel (700) shown in FIG. 2, a display panel (70) in FIG. 7 also includes a low-temperature polysilicon pixel array formed by M rows×N columns of pixel units (for example, 3 rows×4 columns of local pixel units shown in FIG. 7), where both M and N are positive integers. Each pixel unit includes a red subpixel, a green subpixel, and a blue subpixel.

However, different from that the N columns of pixel units respectively correspond to the N operational amplifiers in FIG. 2, only N/2 operational amplifiers are required to assign to the M rows×N columns of pixel units of the display panel (700) in FIG. 7, and the N/2 operational amplifiers include a first operational amplifier to an (N/2)th operational amplifier. Input ends of M red subpixels located in an ath column of pixel units are coupled to an ⌈a/2⌉th operational amplifier through an ath red pixel input switch, input ends of M green subpixels located in the ath column of pixel units are coupled to the ⌈a/2⌉th operational amplifier through an ath green pixel input switch, and input ends of M blue subpixels located in the ath column of pixel units are coupled to the ⌈a/2⌉th operational amplifier through an ath blue pixel input switch.

Therefore, although an architecture of the display panel (700) and configuration of the operational amplifiers shown in FIG. 7 are significantly different from those shown in FIG. 2, the above determination method disclosed in the present invention and the control circuit shown in FIG. 6 are still applicable to the embodiment in FIG. 7. For example, when the determination method of the present invention or the control circuit shown in FIG. 6 determines that a to-be-displayed image has the specific display modes shown in FIG. 3, the flip of the CKH signals may be stopped, and a first red pixel input switch, a second red pixel input switch, a first green pixel input switch, a second green pixel input switch, a first blue pixel input switch, and a second blue pixel input switch are all turned on, which can also achieve the purpose of reducing power consumption.

In addition, the number of operational amplifiers in the embodiment shown in FIG. 7 is only half of the number of operational amplifiers required in FIG. 2 (namely, N/2). Therefore, the power consumption caused by a large number of operational amplifiers can also be significantly reduced, and a chip area is correspondingly reduced.

In an embodiment, a chip may include the control circuits according to the above embodiments, to implement low-power consumption control of the display panel (200) shown in FIG. 2 or the display panel (700) shown in FIG. 7. Further, the above chip and the display panel (for example, a low-temperature poly-silicon pixel array) controlled by the chip may be included in an electronic device.

The control circuit and method for a low-temperature poly-silicon pixel array provided by the present invention can effectively reduce power consumption in specific display modes, reduce heat generation, and prolong the service life of a display screen, a battery, and even an entire electronic product.

It should be noted that, reference throughout the specification to the wording "an embodiment of in the present invention" or a similar term means that a specific feature, structure, or property described together with another embodiment is included in at least one embodiment and may not be necessarily presented in all embodiments. Therefore, when the wording "an embodiment of the present invention" or a similar term correspondingly appears throughout this specification, it do not necessarily refer to a same embodiment.

In addition, the described feature, structure, or property of any specific embodiment may be combined with one or more embodiments in any appropriate manner.

The technical contents and technical features of the present invention have been described by using the foregoing related embodiments. However, the foregoing embodiments are merely examples for implementing the present invention. A person skilled in the art may still make replacements and modifications based on the teachings and the disclosures of the present invention without departing from the spirit of the present invention. Therefore, the disclosed embodiments of the present invention do not limit the scope of the present invention. On the contrary, modifications and equivalent arrangements included in the spirit and scope of the claims are all included in the scope of the present invention.

What is claimed is:

1. A control circuit for a low-temperature poly-silicon pixel array, configured to control the low-temperature poly-silicon pixel array, the low-temperature poly-silicon pixel array comprising:

M rows×N columns of pixel units, wherein each pixel unit comprises a red subpixel, a green subpixel, and a blue subpixel, both M and N being integers greater than 0;

N red pixel input switches, comprising a first red pixel input switch to an Nth red pixel input switch, wherein input ends of M red subpixels located in an ath column of pixel units are coupled to each other, and are coupled to an ath red pixel input switch in the first red pixel input switch to the Nth red pixel input switch, a being an integer from 1 to N;

N green pixel input switches, comprising a first green pixel input switch to an Nth green pixel input switch, wherein input ends of M green subpixels located in the ath column of pixel units are coupled to each other, and are coupled to an ath green pixel input switch in the first green pixel input switch to the Nth green pixel input switch; and N blue pixel input switches, comprising a first blue pixel input switch to an Nth blue pixel input switch, wherein input ends of M blue subpixels located in the ath column of pixel units are coupled to each other, and are coupled to an ath blue pixel input switch in the first blue pixel input switch to the Nth blue pixel input switch, wherein, the control circuit comprises:

N operational amplifiers, comprising a first operational amplifier to an Nth operational amplifier corresponding to a first column of pixel units to an Nth column of pixel units respectively, wherein the input ends of the M red subpixels located in the ath column of pixel units are coupled to an ath operational amplifier through the ath red pixel input switch, the input ends of the M green subpixels located in the ath column of pixel units are coupled to the ath operational amplifier through the ath green pixel input switch, and the input ends of the M blue subpixels located in the ath column of pixel units are coupled to the ath operational amplifier through the ath blue pixel input switch;

a comparison unit, configured to determine whether pixel values of N red subpixels, N green subpixels, and N blue subpixels in at least one row of pixel units of the M rows of pixel units are the same as each other; and a pixel input switch control unit, configured to control, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

2. The control circuit according to claim 1, wherein the determining, by the comparison unit, whether pixel values of N red subpixels, N green subpixels, and N blue subpixels in at least one row of pixel units of the M rows of pixel units are the same as each other comprises: determining whether pixel values of red subpixels, green subpixels, and blue subpixels of a first part of pixel units in the at least one row of pixel units of the M rows of pixel units are all the same as each other; and determining, when it is determined that the pixel values of the red subpixels, the green subpixels, and the blue subpixels of the first part of pixel units in the at least one row of pixel units of the M rows of pixel units are all the same as each other, whether the pixel values of the red subpixels, the green subpixels, and the blue subpixels of the first part of pixel units are all the same as pixel values of red subpixels, green subpixels, and blue subpixels of a second part of pixel units in the same row of pixel units.

3. The control circuit according to claim 1, wherein the comparison unit determines, in a first row of pixel units to an Mth row of pixel units of the M rows of pixel units sequentially, whether the pixel values of the N red subpixels, the N green subpixels, and the N blue subpixels are the same as each other.

4. The control circuit according to claim 2, wherein the first part of pixel units comprise a first pixel unit to a fourth pixel unit in the at least one row of pixel units of the M rows of pixel units, and the second part of pixel units comprise a fifth pixel unit to an eighth pixel unit in the at least one row of pixel units of the M rows of pixel units.

5. The control circuit according to claim 1, wherein the pixel input switch control unit outputs three pixel input switch control signals to control the red pixel input switch, the green pixel input switch, and the blue pixel input switch in any one column of pixel units in the first column of pixel units to the Nth column of pixel units.

6. A chip, comprising:

the control circuit according to claim 1.

7. An electronic device, comprising:

the chip according to claim 6; and the low-temperature poly-silicon pixel array.

8. A control method for a low-temperature poly-silicon pixel array, the low-temperature poly-silicon pixel array comprising:

M rows×N columns of pixel units, wherein each pixel unit comprises a red subpixel, a green subpixel, and a blue subpixel, both M and N being integers greater than 0;

N red pixel input switches, comprising a first red pixel input switch to an Nth red pixel input switch, wherein input ends of M red subpixels located in an ath column of pixel units are coupled to each other, and are coupled to an ath red pixel input switch in the first red pixel input switch to the Nth red pixel input switch, a being an integer from 1 to N;

N green pixel input switches, comprising a first green pixel input switch to an Nth green pixel input switch, wherein input ends of M green subpixels located in the ath column of pixel units are coupled to each other, and are coupled to an ath green pixel input switch in the first green pixel input switch to the Nth green pixel input switch; and N blue pixel input switches, comprising a first blue pixel input switch to an Nth blue pixel input switch, wherein input ends of M blue subpixels located in the ath column of pixel units are coupled to each other, and are coupled to an ath blue pixel input switch in the first blue pixel input switch to the Nth blue pixel input switch, wherein, the control method comprises:

determining whether pixel values of N red subpixels, N green subpixels, and N blue subpixels in at least one row of pixel units of the M rows of pixel units are the same as each other; and controlling, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

9. The control method according to claim 8, wherein the step of determining whether pixel values of N red subpixels, N green subpixels, and N blue subpixels in at least one row of pixel units of the M rows of pixel units are the same as each other comprises:

determining whether pixel values of red subpixels, green subpixels, and blue subpixels of a first part of pixel units in the at least one row of pixel units of the M rows of pixel units are all the same as each other; and determining, when it is determined that the pixel values of the red subpixels, the green subpixels, and the blue subpixels of the first part of pixel units in the at least one row of pixel units of the M rows of pixel units are all the same as each other, whether the pixel values of the red subpixels, the green subpixels, and the blue subpixels of the first part of pixel units are all the same as pixel values of red subpixels, green subpixels, and blue subpixels of a second part of pixel units in the same row of pixel units.

10. The control method according to claim 8, wherein the step of determining whether pixel values of N red subpixels, N green subpixels, and N blue subpixels in at least one row of pixel units of the M rows of pixel units are the same as each other comprises:

determining, in a first row of pixel units to an Mth row of pixel units of the M rows of pixel units sequentially, whether the pixel values of the N red subpixels, the N green subpixels, and the N blue subpixels are the same as each other.

11. The control method according to claim 9, wherein the first part of pixel units comprise a first pixel unit to a fourth pixel unit in the at least one row of pixel units of the M rows of pixel units, and the second part of pixel units comprise a fifth pixel unit to an eighth pixel unit in the at least one row of pixel units of the M rows of pixel units.

12. The control method according to claim 8, further comprising:

outputting three pixel input switch control signals to control the red pixel input switch, the green pixel input switch, and the blue pixel input switch in any one column of pixel units in the first column of pixel units to the Nth column of pixel units.

13. A control circuit for a low-temperature poly-silicon pixel array, configured to control the low-temperature poly-silicon pixel array, the low-temperature poly-silicon pixel array comprising:

M rows×N columns of pixel units, wherein each pixel unit comprises a red subpixel, a green subpixel, and a blue subpixel, M being an integer greater than 0, and N being an even number greater than 0;

N red pixel input switches, comprising a first red pixel input switch to an Nth red pixel input switch, wherein input ends of M red subpixels located in an ath column of pixel units are coupled to each other, and are coupled to an ath red pixel input switch in the first red pixel input switch to the Nth red pixel input switch, a being an integer from 1 to N;

N green pixel input switches, comprising a first green pixel input switch to an Nth green pixel input switch, wherein input ends of M green subpixels located in the ath column of pixel units are coupled to each other, and are coupled to an ath green pixel input switch in the first green pixel input switch to the Nth green pixel input switch; and N blue pixel input switches, comprising a first blue pixel input switch to an Nth blue pixel input switch, wherein input ends of M blue subpixels located in the ath column of pixel units are coupled to each other, and are coupled to an ath blue pixel input switch in the first blue pixel input switch to the Nth blue pixel input switch, wherein, the control circuit comprises:

N/2 operational amplifiers, comprising a first operational amplifier to an (N/2)th operational amplifier, wherein the input ends of the M red subpixels located in the ath column of pixel units are coupled to an ⌈a/2⌉th operational amplifier through the ath red pixel input switch, the input ends of the M green subpixels located in the ath column of pixel units are coupled to the ⌈a/2⌉th operational amplifier through the ath green pixel input switch, and the input ends of the M blue subpixels located in the ath column of pixel units are coupled to the ⌈a/2⌉th operational amplifier through the ath blue pixel input switch;

a comparison unit, configured to determine whether pixel values of N red subpixels, N green subpixels, and N blue subpixels in at least one row of pixel units of the M rows of pixel units are the same as each other; and a pixel input switch control unit, configured to control, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

14. The control circuit according to claim 13, wherein the determining, by the comparison unit, whether pixel values of N red subpixels, N green subpixels, and N blue subpixels in at least one row of pixel units of the M rows of pixel units are the same as each other comprises:

determining whether pixel values of red subpixels, green subpixels, and blue subpixels of a first part of pixel units in the at least one row of pixel units of the M rows of pixel units are all the same as each other; and determining, when it is determined that the pixel values of the red subpixels, the green subpixels, and the blue subpixels of the first part of pixel units in the at least one row of pixel units of the M rows of pixel units are all the same as each other, whether the pixel values of the red subpixels, the green subpixels, and the blue subpixels of the first part of pixel units are all the same as pixel values of red subpixels, green subpixels, and blue subpixels of a second part of pixel units in the same row of pixel units.

15. The control circuit according to claim 13, wherein the comparison unit determines, in a first row of pixel units to an Mth row of pixel units of the M rows of pixel units sequentially, whether the pixel values of the N red subpixels, the N green subpixels, and the N blue subpixels are the same as each other.

16. The control circuit according to claim 14, wherein the first part of pixel units comprise a first pixel unit to a fourth pixel unit in the at least one row of pixel units of the M rows of pixel units, and the second part of pixel units comprise a fifth pixel unit to an eighth pixel unit in the at least one row of pixel units of the M rows of pixel units.

17. The control circuit according to claim 13, wherein the pixel input switch control unit outputs six pixel input switch control signals to control the red pixel input switch, the green pixel input switch, and the blue pixel input switch in any one column of pixel units in the first column of pixel units to the Nth column of pixel units.

18. A chip, comprising:

the control circuit according to claim 13.

19. An electronic device, comprising:

the chip according to claim 18; and the low-temperature poly-silicon pixel array.

20. A control method for a low-temperature poly-silicon pixel array, the low-temperature poly-silicon pixel array comprising:

M rows×N columns of pixel units, wherein each pixel unit comprises a red subpixel, a green subpixel, and a blue subpixel, both M and N being integers greater than 0;

N red pixel input switches, comprising a first red pixel input switch to an Nth red pixel input switch, wherein input ends of M red subpixels located in an ath column of pixel units are coupled to each other, and are coupled to an ath red pixel input switch in the first red pixel input switch to the Nth red pixel input switch, a being an integer from 1 to N;

N green pixel input switches, comprising a first green pixel input switch to an Nth green pixel input switch, wherein input ends of M green subpixels located in the ath column of pixel units are coupled to each other, and are coupled to an ath green pixel input switch in the first green pixel input switch to the Nth green pixel input switch; and N blue pixel input switches, comprising a first blue pixel input switch to an Nth blue pixel input switch, wherein input ends of M blue subpixels located in the ath column of pixel units are coupled to each other, and are coupled to an ath blue pixel input switch in the first blue pixel input switch to the Nth blue pixel input switch, wherein, the control method comprises:

determining whether pixel values of N red subpixels, N green subpixels, and N blue subpixels in at least one row of pixel units of the M rows of pixel units are the same as each other; and controlling, when the pixel values of the N red subpixels, the N green subpixels, and the N blue subpixels in the at least one row of pixel units of the M rows of pixel units are the same as each other, the N red pixel input switches, the N green pixel input switches, and the N blue pixel input switches to be all turned on.

21. The control method according to claim 20, wherein the step of determining whether pixel values of N red subpixels, N green subpixels, and N blue subpixels in at least one row of pixel units of the M rows of pixel units are the same as each other comprises:

determining whether pixel values of red subpixels, green subpixels, and blue subpixels of a first part of pixel units in the at least one row of pixel units of the M rows of pixel units are all the same as each other; and determining, when it is determined that the pixel values of the red subpixels, the green subpixels, and the blue subpixels of the first part of pixel units in the at least one row of pixel units of the M rows of pixel units are all the same as each other, whether the pixel values of the red subpixels, the green subpixels, and the blue subpixels of the first part of pixel units are all the same as pixel values of red subpixels, green subpixels, and blue subpixels of a second part of pixel units in the same row of pixel units.

22. The control method according to claim 20, wherein the step of determining whether pixel values of N red subpixels, N green subpixels, and N blue subpixels in at least one row of pixel units of the M rows of pixel units are the same as each other comprises:

determining, in a first row of pixel units to an Mth row of pixel units of the M rows of pixel units sequentially, whether the pixel values of the N red subpixels, the N green subpixels, and the N blue subpixels are the same as each other.

23. The control method according to claim 21, wherein the first part of pixel units comprise a first pixel unit to a fourth pixel unit in the at least one row of pixel units of the M rows of pixel units, and the second part of pixel units comprise a fifth pixel unit to an eighth pixel unit in the at least one row of pixel units of the M rows of pixel units.

24. The control method according to claim 20, further comprising:

outputting six pixel input switch control signals to control the red pixel input switch, the green pixel input switch, and the blue pixel input switch in any one column of pixel units in the first column of pixel units to the Nth column of pixel units.

* * * * *